US006369372B1

(12) United States Patent
Kim

(10) Patent No.: US 6,369,372 B1
(45) Date of Patent: Apr. 9, 2002

(54) WALL-MOUNTED MICROWAVE OVEN

(75) Inventor: An-sik Kim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/798,967

(22) Filed: Mar. 6, 2001

(30) Foreign Application Priority Data

Oct. 26, 2000 (KR) ..... 12/63221

(51) Int. Cl.[7] ..... H05B 6/80

(52) U.S. Cl. ..... 219/756; 219/757; 126/273 A; 126/299 D; 312/236

(58) Field of Search ..... 219/756, 757, 219/400; 126/21 A, 273 A, 275 E, 299 R, 299 D; 312/236

(56) References Cited

U.S. PATENT DOCUMENTS 3,911,893 A * 10/1975 Baker et al. ..... 126/21 A
4,935,593 A * 6/1990 Nishikawa ..... 126/273 A
5,286,940 A * 2/1994 Leeds ..... 126/273 A
5,967,634 A * 10/1999 Baca ..... 126/273 A
6,072,169 A * 6/2000 Kang et al. ..... 219/757

* cited by examiner

*Primary Examiner*—Philip H. Leung
(74) *Attorney, Agent, or Firm*—Robert E. Bushnell, Esq.

(57) ABSTRACT

Disclosed is a wall-mounted type microwave oven suspended on an installation surface, including a main body formed with a cooking chamber and a component chamber, an outer casing enclosing the main body, defining an outer appearance of the microwave oven, and a grill member installed between the main body and the outer casing, comprising at least one bracket having one end coupled to the main body and the other end coupled to the installation surface together with the planar surface of the outer casing; and a plurality of fastening members for coupling the reinforcement bracket and the outer casing to the installation surface. With this configuration, there is provided a microwave oven capable of being easily mounted in suspension structure where there is no cabinet having an installation space.

16 Claims, 4 Drawing Sheets

WALL-MOUNTED MICROWAVE OVEN

CLAIM OF PRIORITY

This application makes reference to, incorporates the same herein, and claims all benefits accruing under 35 U.S.C. §119 from my application entitled WALL MOUNTED TYPE MICROWAVE OVEN filed with the Korean Industrial Property Office on Oct. 26, 2000 and there duly assigned Ser. No. 2000/63221.

BACKGROUND OF THE INVENTION

1. Field of the Invention

The present invention relates in general to microwave ovens, and more particularly, to a wall-mounted microwave oven suspended by a wall face to be coupled therewith.

2. Description of Related Art

A microwave oven is a household electronic appliance cooking food by electromagnetic waves generated from a magnetron. The microwave oven is generally installed on the top face of a sink unit or accommodated in a space of the sink unit. However, the so-called wall-mounted microwave oven or OTR (over the range) is mounted on the bottom face of a kitchen cabinet arranging therein glassware, etc., for the sake of user's convenience, or considering the kitchen space or an interior, etc.

The wall-mounted microwave oven is comprised of a main body formed with a cooking compartment and a component chamber, and an outer casing of an inverse "U" shape, covering the main body. The top face of the outer casing has a plurality of screw holes for screw-coupling with a plurality of through holes formed on the bottom face of the cabinet.

To couple the microwave oven to the bottom face of the cabinet, the microwave oven is first lifted up and the outer casing is arranged such that the screw holes formed therein correspond with the through holes formed in the bottom face of the cabinet. After opening a door of the cabinet, bolts are inserted from the inside of the cabinet into the respective through holes in the bottom face of the cabinet, and they are engaged with the screw holes in the top face of the outer casing, thereby allowing the microwave oven to be mounted on the wall face.

However, to mount the conventional microwave oven, the cabinet is required. Thus, to mount the microwave oven in suspension structure where there is no cabinet, the above-described processes cannot be applied, and it is not easy to mount the microwave oven.

SUMMARY OF THE INVENTION

Accordingly, the present invention has been made keeping in mind the above-described shortcoming, and an object of the present invention is to provide a microwave oven capable of being easily mounted in suspension structure where there is no cabinet.

This and other objects of the present invention may be achieved by a provision of a wall-mounted type microwave oven suspended on an installation surface, including a main body formed with a cooking chamber and a component chamber, an outer casing enclosing the main body, defining an outer appearance of the microwave oven, and a grill member installed between the main body and the outer casing, the oven comprising at least one bracket having one end coupled to the main body and the other end coupled to the installation surface together with the planar surface of the outer casing; and a plurality of fastening members for coupling the reinforcement bracket and the outer casing to the installation surface.

Preferably, the reinforcement bracket is disposed adjacent to the grill member.

The reinforcement bracket is comprised of a first flange coupled to the main body, a second flange coupled to the installation surface together with the outer casing, and a connection part connecting the first flange and the second flange and coupled to the grill member.

The oven further comprises a reinforcement plate installed to a wall in the rear of the microwave oven and having at least one protrusion formed at a lower end portion thereof, wherein the main body includes a bottom plate formed with an engagement hole with which the protrusion of the reinforcement plate is engaged.

Preferably, the engagement member is comprised of a fixed screw.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
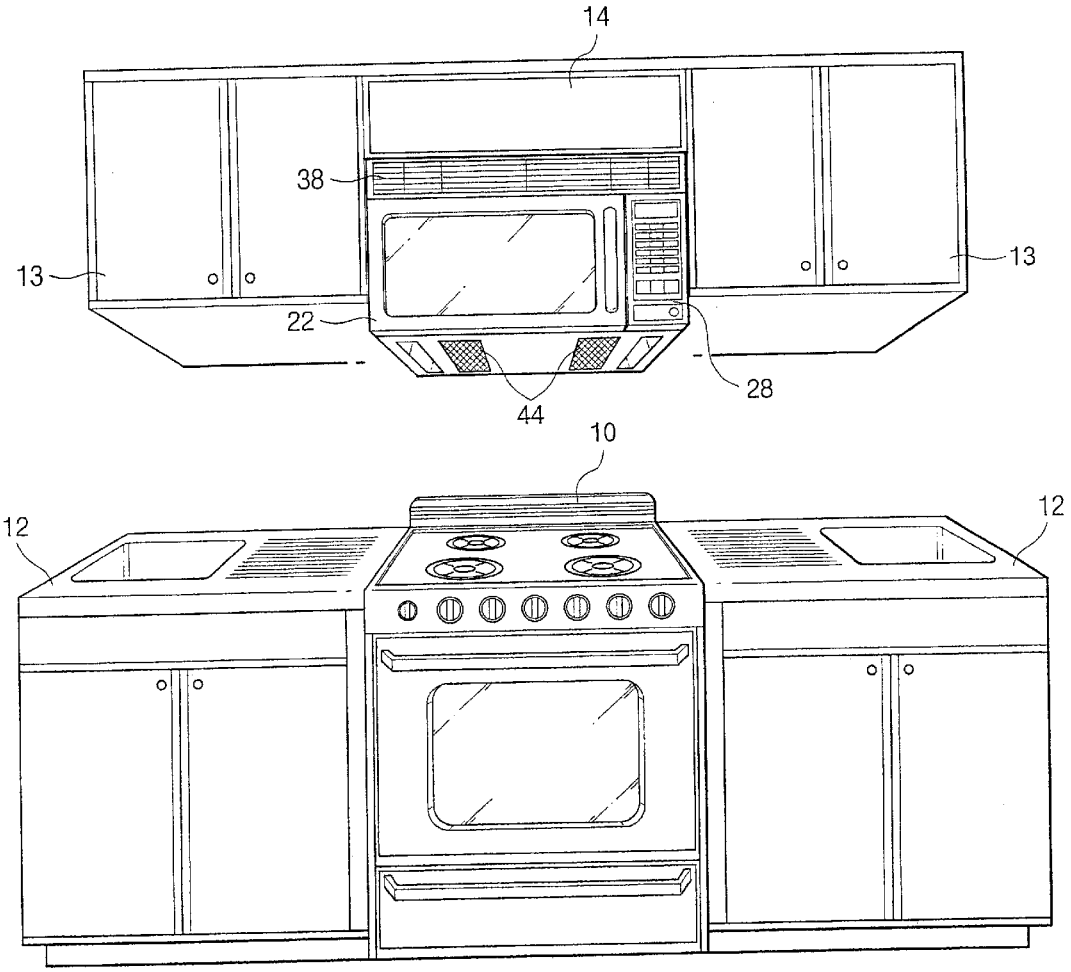
FIG. 1 is a view showing an installation state of a wall-mounted microwave oven according to the present invention.

Referring to FIG. 1, a kitchen is usually provided with a gas range 10 for cooking food, and a sink cabinet 12. Over the gas range 10 is provided a wall-mounted microwave oven having an exhaust duct for exhausting smoke and steam generated during cooking to outdoor.

Figure 2:
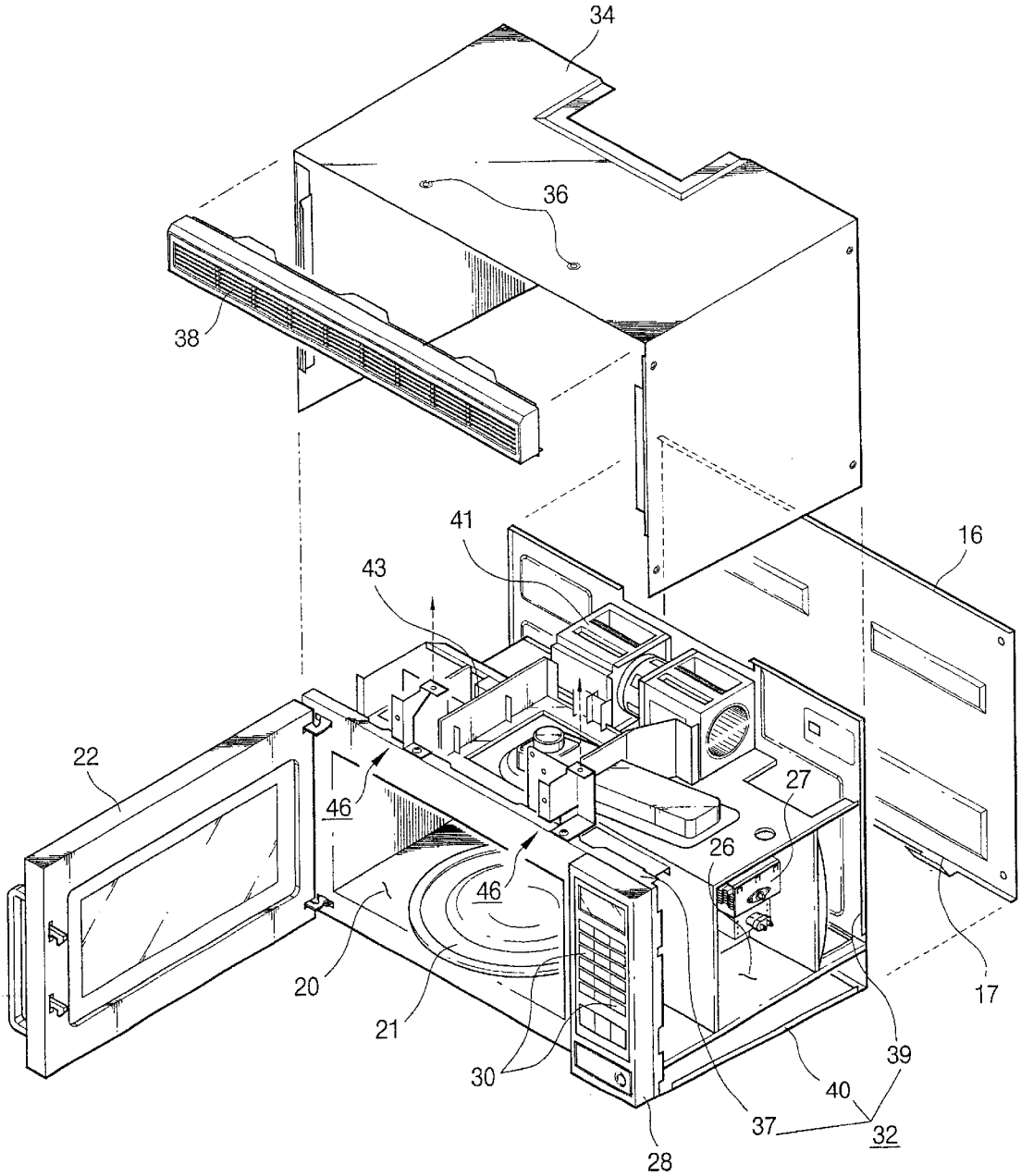
FIG. 2 is an exploded perspective view of the wall-mounted microwave oven according to the present invention.

Generally, the wall-mounted microwave oven is mounted to a cabinet 13 having a shelf upon which glassware and/or kitchenware are arranged. However, by way of example, it is assumed in the present embodiment that there is only an installation surface 14 (hereinafter, "shelf plate 14") without the cabinet 13. In rear of the microwave oven is vertically provided a reinforcement plate 16 fixed on a rear wall face, relative to the shelf plate 14, as shown in FIG. 2. Preferably, the reinforcement plate 16 is made of metallic material. On the lower part of the reinforcement plate 16 are formed a pair of projections 17 to be engaged with the rear lower face of the microwave oven, thereby supporting the microwave oven.

Figure 3:
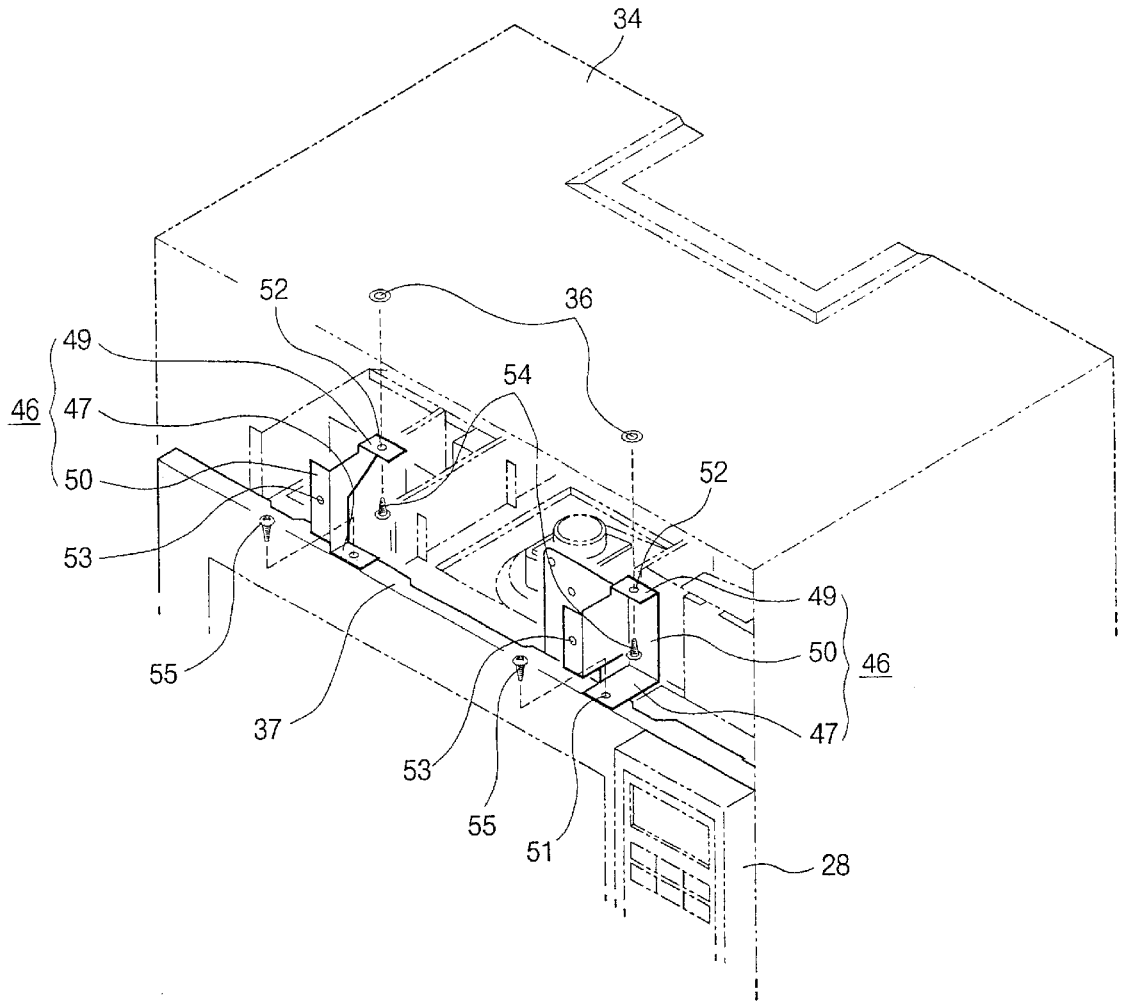
FIG. 3 is an enlarged view of a main portion of FIG. 2.

Referring to FIGS. 2 and 3, the wall-mounted microwave oven according to the present invention includes a main body 32 formed with a cooking chamber 20 and a component chamber 26, and an outer casing 34 taking a shape of inverse "U," enclosing the main body, thereby defining an outer appearance of the microwave oven.

Within the cooking chamber 20 is provided a tray 21 upon which food to be cooked is put. In front of the cooking chamber 20 is provided a door 22 opening and closing the cooking chamber 20. Within the component chamber 26 are installed a magnetron 27 generating electromagnetic waves, and a variety of components (not shown) employed for operating the microwave oven. In front of the component chamber 26 is mounted a control panel 28 having a number of manipulating buttons 30 for cooking.

The main body 32 is comprised of a front plate 37, a rear plate 39 and a bottom plate 40. Between the main body 32 and the outer casing 34 is formed an air path for air flow. The air path is provided with a suction motor 41 for sucking the air into the air path between the main body 32 and the outer casing 34, and a guide duct 43 for guiding the sucked air to the outside of the main body 32.

Figure 4:
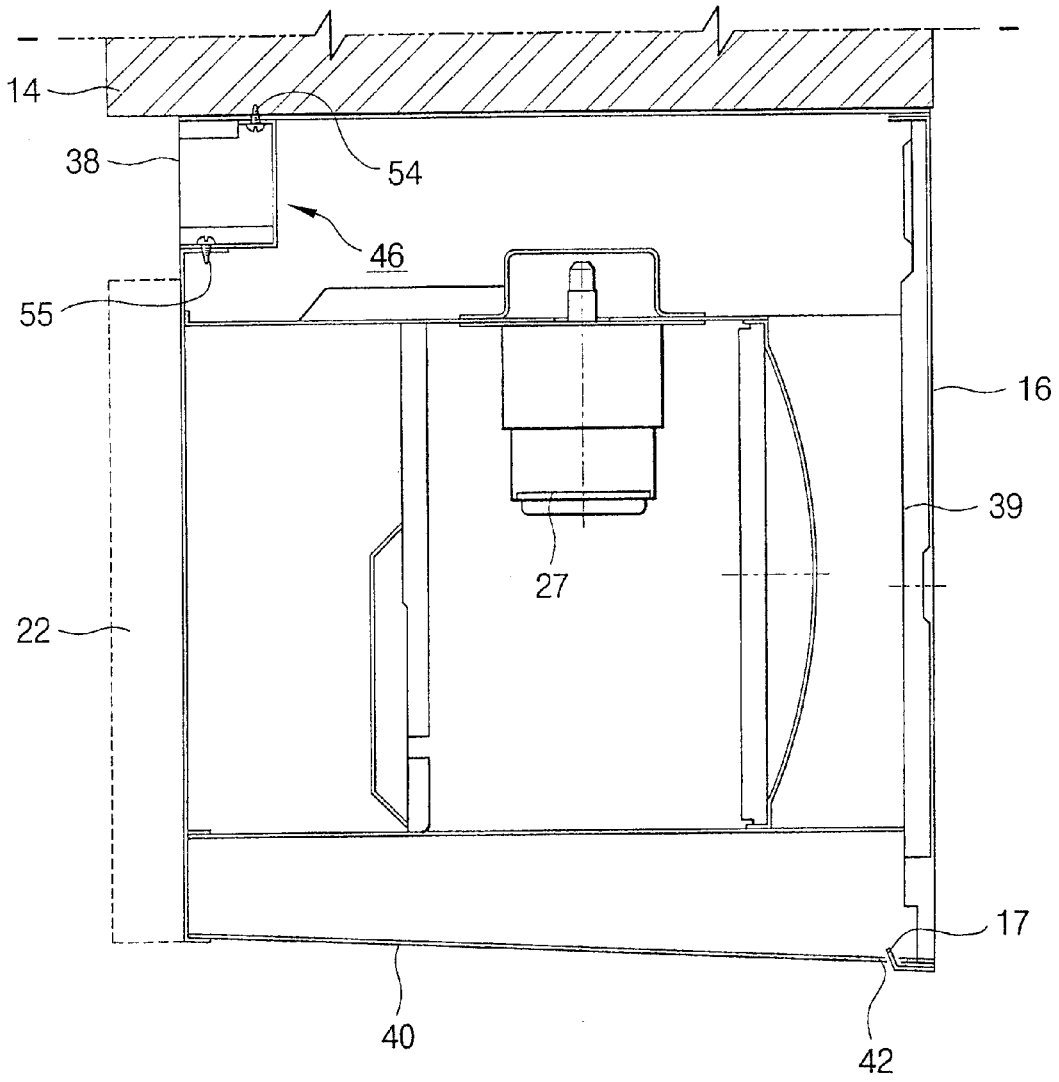
FIG. 4 is a sectional view showing an installation state of the wall-mounted microwave oven according to the present invention.

Between the top of the front plate 37 and the outer casing 34 is installed a grill member 38, for discharging the steam and smell generated during cooking. As shown in FIG. 4, in the rear of the bottom plate 40 are formed a pair of engagement holes 42 with which the projections 17 of the reinforcement plate 16 are engaged. On the bottom plate 40 are also formed a plurality of inlet ports 44 for allowing the steam and smoke generated during cooking with the gas range 10 to flow into the microwave oven, as shown in FIG. 1.

If the suction motor 41 is operated, the steam and smoke generated from the food are flown into the air path between the main body 32 and the outer casing 34 by the-suction force of the suction motor 41, through the inlet ports 44 formed on the bottom plate 40, and then guided by the guide duct 43 to thereby be discharged outside through the grill member 38.

As shown in FIGS. 3 and 4, a pair of support brackets 46 are provided between the main body 32 and the outer casing 34, adjacent to the opposite sides of the grill member 38. Each of the support brackets 46 is comprised of a first flange 47 disposed on the top surface of the front plate 37, a second flange 49 coupled with a top plate of the outer casing 34, and a connection part 50 connecting the first and second flanges 47 and 49 and coupled to the grill member 38. The first and second flanges 47 and 49, and the connection part 50 can be integrally formed of stainless steel or engineering plastic, etc.

On the planar surfaces of the first flange 47 and the connection part 50 are formed holes 51 and 53 for screw-coupling with the front plate 37 and the grill member 38 with a screw 55. The second flange 49 and the outer casing 34 in contact with each other are formed with holes 52 and 36 communicating with each other, respectively.

A screw 54 is inserted through the communicating holes 52 and 36 to be engaged with the shelf plate 14.

The shelf plate 14 may be injection-molded with a wood or a synthetic plastic. In this case, where the screw 54 is engaged with the shelf plate 14 through the communicating holes 52 and 36 of the second flange and the outer casing 34, there is no need to form a separate screw hole on the shelf plate 14. However, where the shelf plate 14 is made on metal, there is a need to form a separate screw hole on the shelf plate 14.

Hereinbelow, a process of combining the wall-mounted microwave oven with the shelf plate 14 in a suspension structure will be described with reference to FIG. 4.

First, the grill member 38 is separated from the main body 32 and then the support brackets 46 are screw-coupled with the front plate 37 by fastening the screw 55 through the hole 51 formed in the first flange 47. Then, the microwave oven is lifted up and the engagement holes 42 formed on the bottom plate 40 thereof are engaged with the projections 17 of the reinforcement plate 16.

Then, the support brackets 46 are screw-coupled with the shelf plate 14 by fastening the screw 54 through the communicating holes 52 and 36 of the second flange 49 and the outer casing 34. Then, the grill member 38 is screw-coupled to the support brackets 46. Hence, the installation process of the microwave oven is completed.

As described above, the wall-mounted microwave oven according to the present invention is provided with the plurality of reinforcement brackets 46 having one end coupled to the main body 32 and the other end disposed in contact with the planar surface of the outer casing 34; and the plurality of fastening members coupling the reinforcement brackets 46 and the outer casing 34 to the shelf plate 14, thereby enabling the microwave oven to be easily suspended on the shelf plate 14.

The above-described embodiment has used the screw 54 as the fastening member, but a rivet or a nail may replace the fixed screw.

The reinforcement brackets 46 have been disposed adjacent to the grill member 38 since the front plate 37 has a relatively high strength and the installation of the microwave oven is facilitated. However, the reinforcement brackets may be installed to any different position.

As described above, there is provided a microwave oven capable of being easily mounted in suspension structure where there is no cabinet having an installation space.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A wall-mounted type microwave oven suspended on an installation surface, including a main body formed with a cooking chamber and a component chamber, an outer casing enclosing said main body and defining an outer appearance of the microwave oven, and a grill member installed between said main body and said outer casing, comprising:

a reinforcement bracket coupled to said main body and said installation surface together with the planar surface of said outer casing, said reinforcement bracket disposed adjacent to said grill member;

a plurality of fastening members for coupling said reinforcement bracket and said outer casing to the installation surface; and said reinforcement bracket including a first flange coupled to said main body, a second flange coupled to said installation surface together with said outer casing, and a connection part connecting said first flange and said second flange and coupled to said grill member.

2. The oven of claim 1, further comprising:

a reinforcement plate installed to a wall disposed in a rear side of the microwave oven and having at least one protrusion formed at a lower end portion thereof; and said the main body including a bottom plate formed with an engagement hole with which said protrusion of said reinforcement plate is engaged.

3. A wall-mounted type microwave oven suspended on an installation surface, comprising:

a main body formed with a cooking chamber and a component chamber;

an outer casing enclosing said main body;

a grill member installed between said main body and said outer casing; and a reinforcement bracket disposed between said main body and said outer casing, having a first flange coupled to said main body and a second flange coupled to said installation surface through said outer casing.

4. An oven of claim 3, further comprising a connecting portion connecting said first flange and said second flange and being coupled to said grill member.

5. The oven of claim 4, further comprising a fastening member coupling said first flange of said reinforcement bracket and said outer casing to said installation surface.

6. The oven of claim 5, further comprising a through hole formed on said outer casing, said fastening member passing through said through hole when coupling said second flange to said installation surface.

7. The oven of claim 4; with said reinforcement bracket made as a monolithic structure.

8. The oven of claim 4, with said first flange being substantially parallel to said second flange.

9. The oven of claim 4, with said connecting portion extended toward said grill member.

10. The oven of claim 4, further comprising:

a reinforcement plate mounted on a wall disposed on a rear side of the oven, having a protrusion; and said main body including a bottom plate formed with an engagement hole being engaged with said protrusion.

11. A wall-mounted type microwave oven, comprising:

a main body formed with a cooking chamber and component chamber;

an outer casing enclosing said main body;

a grill member installed between said main body and said outer casing; and a reinforcement bracket disposed between said main body and said outer casing, having a first flange coupled to said main body, a second flange coupled to said outer casing, and a connecting portion connecting said first flange and said second flange and coupled to said grill member.

12. The oven of claim 11, with said second flange adapted to be coupled to an installation surface disposed outside said oven.

13. The oven of claim 12, further comprising a fastening member coupling said second flange and said outer casing to said installation surface.

14. The oven of claim 11, with said reinforcement bracket made in a single body.

15. The oven of claim 11, with said main body comprising a bottom plate adapted to be coupled to a reinforcement plate disposed outside said oven.

16. The oven of claim 15, with said bottom plate having an engagement hole being engaged with a protrusion formed on said reinforcement plate.

* * * * *